United States Patent [19]

Krause

[11] 4,170,988

[45] Oct. 16, 1979

[54] THERAPEUTIC APPARATUS

[76] Inventor: Nicolaas J. P. R. Krause, 35 Machine St., Elsburg, South Africa

[21] Appl. No.: 849,297

[22] Filed: Nov. 7, 1977

[51] Int. Cl.[2] ..... A61H 1/00

[52] U.S. Cl. ..... 128/24 R; 128/68

[58] Field of Search ..... 128/24 R, 68, 70, 71

[56] References Cited

U.S. PATENT DOCUMENTS

| | | | |
|---|---|---|---|
| 1,644,043 | 10/1927 | Tiedemann | 128/68 UX |
| 2,874,689 | 2/1959 | Gavelek | 128/24 R |
| 2,932,038 | 4/1960 | Sprague | 5/62 |
| 3,152,802 | 10/1964 | Heisler et al. | 128/24 R |
| 3,463,145 | 8/1969 | Whitaker | 128/24 R |
| 3,568,669 | 3/1971 | Stites | 128/71 |

*Primary Examiner*—Lawrence W. Trapp
*Attorney, Agent, or Firm*—Karl W. Flocks

[57] ABSTRACT

The invention provides for a therapeutic apparatus which includes a platform on which a person can be supported in a reclining position, and a support on which the platform is pivotally supported. The platform can pivot about a pivot axis between one extreme position in which a person on the platform is in a substantially upright standing position and another extreme position in which the person on the platform is in a substantially upright inverted position. The apparatus includes adjustment means by means of which the platform can be adjusted in at least two directions with respect to the platform to thereby adjust the position of the center of gravity of the platform and its load with respect to the fulcrum. The adjustment means for adjusting the platform in at least one direction effects infinite angular adjustment of the platform.

15 Claims, 5 Drawing Figures

THERAPEUTIC APPARATUS

BACKGROUND TO THE INVENTION

This invention relates to a therapeutic apparatus.

According to the invention there is provided a therapeutic apparatus including a support, an elongate planar platform for supporting a person in a reclining position, the platform being pivotally mounted on a fulcrum on the support so as to be pivotally displaceable about a pivotal axis transverse to the longitudinal direction of the platform, the support being adapted to support the fulcrum in a sufficiently elevated position so that the platform can pivot between one extreme position in which it is in a substantially upright position and another extreme position in which it is in a substantially upright inverted position, and adjustment means for adjusting the platform with respect to the fulcrum in at least two directions transverse to one another, at least one direction being transverse to the plane of the platform, and the adjustment means for adjusting the platform in at least one direction being infinitely angularly adjustable.

The adjustment in the direction transverse to the plane of the platform may be effected by means of the adjustment means which is infinitely angularly adjustable. This adjustment means may include a screw and nut mechanism.

Conveniently, the adjustment means which is infinitely angularly adjustable may include a cradle member which is pivotally mounted on the support and to which the platform is pivotally connected. This adjustment means may further include a sleeve member and a rod member, the rod member being slidably received in the sleeve member, one of the members being fast with the platform and the other member being fast with the cradle member via a pivotal connection so that the platform is slidable as well as pivotable with respect to the cradle member via the sleeve and rod members.

The apparatus may further include a skid member interposed between the platform and the cradle member and being fast with one of these parts and being in slidable contact with the other part at the pivotal connection between these parts.

Conveniently, the screw and nut mechanism may be interposed between the cradle member and the platform with the screw being rotatably mounted in one of these parts and the nut being fast with the other part and with the screw being screwingly mounted in the nut so that upon rotation of the screw the nut is axially displaced on the screw to thereby effect angular displacement of the platform about its pivotal connection to the cradle member.

The pivotal connection between the platform and the cradle member may comprise a hinge connection.

Conveniently, the adjustment means for each direction includes a pair of relatively movable members.

The apparatus may include a carriage comprising at least one pair of relatively movable parts, the platform being secured to one of the parts and the adjustment means being provided to be operative between the relatively movable parts to effect relative movement of the parts when the adjustment means is operated.

The adjustment means may include a screw and nut mechanism operable between the relatively movable parts to effect relative movement between the parts.

If desired, the pivotal mounting of the platform in the support may be adjustable.

Conveniently, the adjustment means in one direction may be linearly adjustable. In this arrangement the adjustment means may be adjustable in the longitudinal direction of the platform. Still further, this adjustment means may be infinitely linearly adjustable by means of a screw and nut mechanism.

The support may comprise a free-standing framework having formations constituting the fulcrum to support the platform in trunnion-fashion at the fulcrum.

The apparatus may further include means for securing a person to the platform so as to retain the person on the platform when the platform is pivoted from one extreme position to the other. The securing means may comprise clamps adapted to be clamped to the ankles of a person.

The invention is now described by way of examples with reference to the accompanying drawings, in which.

Figure 1:
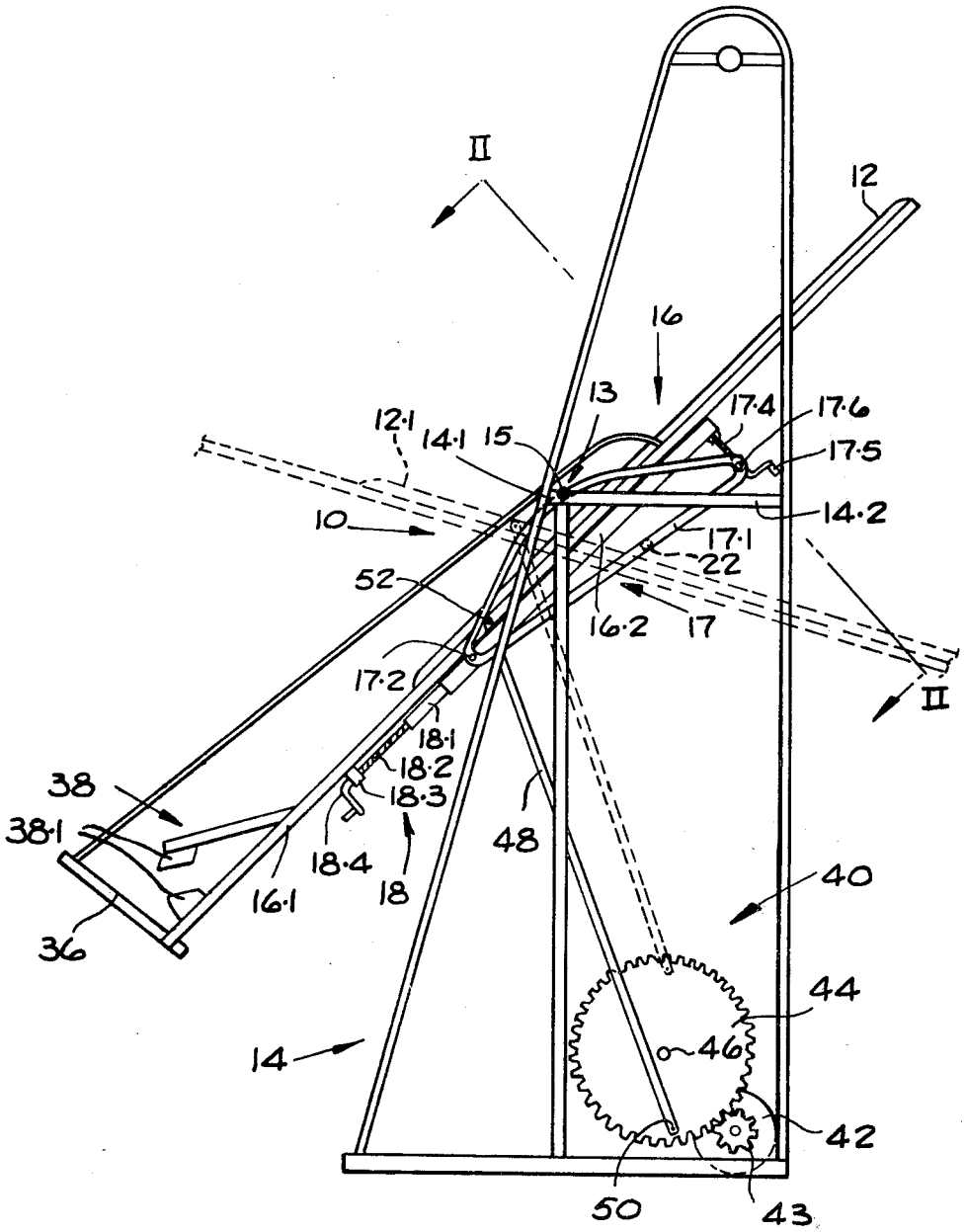
FIG. 1 is a side view of a therapeutic apparatus according to one embodiment of the invention.

In the drawings, reference numeral 10 generally indicates a therapeutic apparatus comprising an elongate platform 12 pivotally mounted on a stationary support frame 14.

The platform 12 is mounted on a carriage 16, and the carriage 16 has an axle in the form of a pair of pins 15 projecting laterally of the platform 12.

The frame 14 is free standing and it comprises a pair of parallel side members 14.1 interconnected by horizontal connection members (not shown). The side members 14.1 (only one being shown in FIG. 1) each has an inwardly and upwardly projecting flange 14.2 provided with a semi-circular recess 13 therein for supporting the pair of pins 15, thereby forming a pair of fulcra for the platform 12.

The carriage 16 includes a pair of rectangular frames 16.1 and 16.2. The frame 16.1 is welded to the underside of platform 12. The frame 16.2 is larger than the frame 16.1 and it has a pair of channel-sectioned members along two of its opposite sides extending longitudinally of the platform 12. The frame 16.1 has flanges 16.3 provided with rollers 16.11 located for guided movement in the channel-sectioned members. The frames 16.1 and 16.2 are therefore capable of relative sliding movement in a direction longitudinally of the platform 12.

Relative adjustment of the frames 16.1 and 16.2 is effected by means of a screw mechanism 18. The screw mechanism 18 comprises an internally screw threaded tube 18.1, welded at one end to the centre of a cross member of the frame 16.2. The screw mechanism 18 also comprises a screw 18.2 engaged in the threaded tube 18.1. The screw 18.2 is rotatable but axially constrained in a bearing block 18.3, fast with an unshown cross member of the frame 16.1. A handle 18.4 is fastened on the end of the screw 18.2. Rotation of the handle 18.4 moves the screw 18.2 in or out of the tube 18.1, causing relative longitudinal motion between the frames 16.1 and 16.2.

Since the screw mechanism 18 is not self-reversible there is generally no need of a locking mechanism, but if it is found necessary to lock the relative positions of the frames 16.1 and 16.2 after adjustment any suitable form of locking means may be employed, such as a pin inserted through aligned holes in the frames 16.1 and 16.2.

The apparatus further includes a cradle 17 comprising two parallel generally triangular shaped frames 17.1, spaced one each side of the frame 16.2, and joined by appropriate unshown cross members. The cradle 17 is pivoted to the frame 16.2 by transverse pins 17.2 at one corner of the triangle. The apices of the triangular frames 17.1 are pivoted to the stationary support frame 14 by the pins 15.

The remaining corners of the triangular frames 17.1 have a bar 17.3 pivoted thereon at 17.6. The centre of the bar 17.3 has a screw threaded bore therethrough in which a co-operating screw 17.4 is engaged. One end of the screw 17.4 has a handle 17.5 affixed thereto, to rotate the screw 17.4. The other end of the screw 17.4 is rotatable but axially constrained in a bore through the centre of a bar 19, which is pivoted at its end in brackets 20, fastened to the frame 16.2. Since the screw 17.4 acts in a direction generally normal to the plane of the frame 16.1 and of the elongate platform 12, operation of the screw 17.4 causes the cradle 17 to be angularly displaced by pivoting about the pins 17.2. Thereby the plane of the platform 12 is moved nearer to or away from the axis of the pivot pins 15.

The screw 17.4, like the screw mechanism 18, is not self-reversible and therefore there is generally no need of a locking mechanism. If found necessary, however, a locking mechanism may be provided such as a pin insertable through aligned holes in the bar 17.3 and the screw 17.4.

Although the pivot pins 17.2 have been shown at the lower end of the cradle 17, in FIG. 1, they could be at the upper end, provided that the axis of the pivot pins 17.2 is spaced away from a plane through the axis of the pivot pins 15 and normal to the plane of the platform 12.

The two frames 17.1 are rigidly secured to one another by means of a spacer bar 22 shown end on in dotted lines in FIG. 1.

The embodiment described above allows relative adjustment of the platform 12 with respect to its pivotal axis through an infinite number of positions between two extreme positions. The screw 17.4 permits fine adjustments of the platform 12 relative to the pins 15 to be made easily and accurately.

In use of the apparatus 10, the platform 12 is initially positioned substantially upright. A person (not shown) steps on a footrest 36 fast with the frame 16.1 and leans back with his back against the platform 12. The person clamps his ankles in a clamp 38 which includes two opposed pairs of clamping members 38.1, one pair for each ankle. The operation of the clamping members 38.1 is described with reference to FIG. 5. The platform 12 is adjusted with respect to its pivotal axis in the lengthwise and the antero—posterior directions respectively, so that the pivotal axis passes as closely as possible through the centre of gravity of the platform 12 plus its load. When this adjustment has been effected, inversion of the person on the platform 12 may be effected more easily by extension of the person's arms above the head. The platform 12 may also more easily be maintained in any other position, such as for example, the horizontal position. In addition, the return from the inverted position to the upright position may more easily be effected slowly when the platform 12 is thus correctly adjusted.

A rocking mechanism 40 is provided to rock the platform 12 about the pins 15. The rocking mechanism comprises an electric motor 42 having a pinion 43 driving a gear wheel 44 about a shaft 46. A connecting rod 48 is pivotably connected at 50 to the gear wheel and at 52 to the platform 12. When the pinion 43 is rotated, the platform 12 is rocked about the pins 15 between the position shown in solid lines and the position 12.1 shown in dotted lines.

Figure 2:
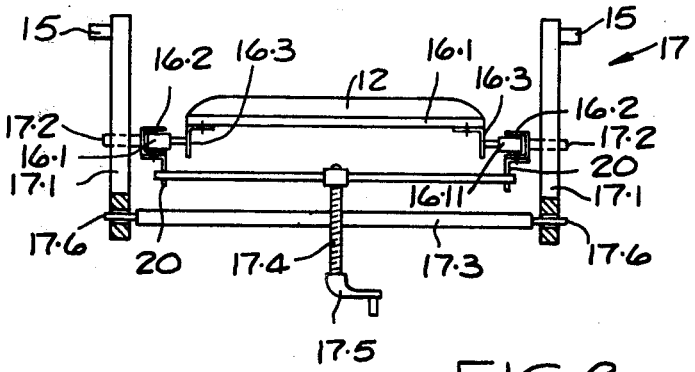
FIG. 2 is a cross-section along the line II—II in FIG. 1, of an inclinable part of the therapeutic apparatus.
Figure 3:
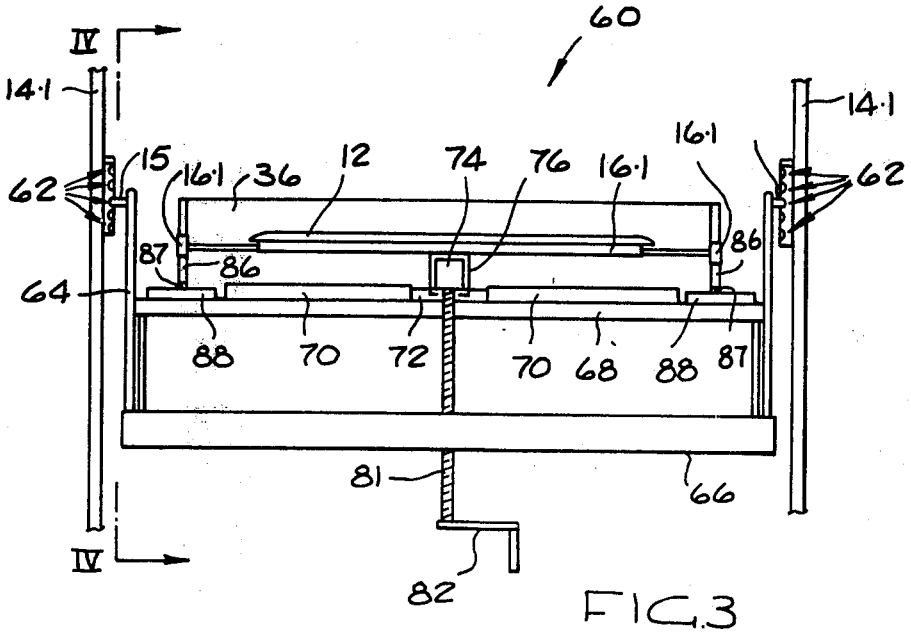
FIG. 3 is an end view similar to FIG. 2 but on an enlarged scale of an alternative embodiment of an inclinable part of the apparatus shown in FIG. 1.
Figure 4:
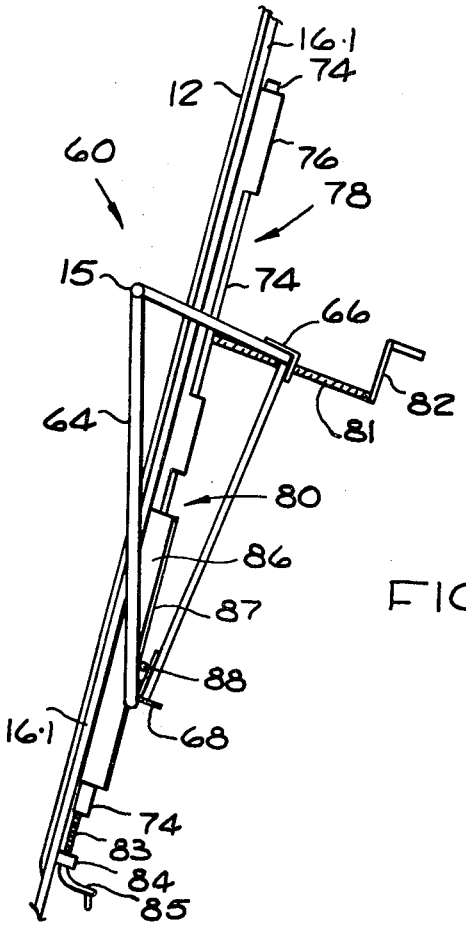
FIG. 4 is side view on line IV—IV of the inclinable part shown in FIG. 3.

Referring now to FIGS. 3 and 4, there is shown a cradle 60 similar to but constructionally different from the cradle 17 shown in FIGS. 1 and 2. The cradle 60 just like the cradle 17, supports the platform 12 and is itself supported via the pins 15 by the side members 14.1 of the frame 14 shown in FIGS. 1 and 2. A series of vertically spaced apertures 62 are provided on each side member 14.1 so that the vertical position of the pins 15 and thus of the cradle 60 with respect to the side members 14.1 can be adjusted.

The cradle 60 includes two parallel triangular shaped frames 64 interconnected by two cross members 66 and 68. The pins 15 are provided at the apices of the frames 64. Two longitudinally spaced sleeves 70 are provided fast with the cross member 68, and a shaft 72 is rotatable in the sleeves 70. The shaft 72 is fast with a rod 74 which is captive in and slidably received for guided linear movement in a sleeve 76 fast with the frame 16.1 of supporting platform 12. The rod 74 is conveniently a square tube. The sleeve 76 is notched as at 78 and 80 so that the rod 74 is exposed where parts such as the shaft 72 are secured to it.

The centre of the bar 66 has a screw threaded bore therethrough in which a co-operating screw 81 is engaged. One end of the screw 81 has a handle 82 affixed thereto to rotate the screw 81. The other end of the screw 81 is rotatable but axially constrained in a bore in the rod 74. By rotating the screw 81 the rod 74 is displaced with respect to the cross member 66. Since the rod 74 is fast with the shaft 72 which is rotatable in the sleeve 70 which is itself fast with the cross member 68, the rod 74 is pivoted with respect to the sleeve 70 and is thus angularly displaced about the cross member 68 when the screw 81 is rotated. The rotation of the screw 81 therefore effects angular displacement of the platform 12 about the cross member 68.

Relative linear adjustment of the platform 12 with respect to the cradle 60 is effected by means of a screw 83. The screw 83 is rotatable but axially constrained in a bearing block 84 fast with the frame 16.1 supporting the platform 12. A handle 85 is fast with the end of the screw 83. The screw 83 is engaged in a screw threaded bore provided in one end of the tubular rod 74. Rotation of the handle 85 moves the screw 83 into or out of the hollow rod 74, causing relative linear longitudinal motion between the rod 74 and the sleeve 76 and thus between the platform 12 and the pins 15.

The screws 81 and 83 are not self-reversible and thus a locking mechanism is not required but it may be provided if desired.

Referring further to FIGS. 3 and 4, there are provided two elongate parallel skid members 86 fast with the frame 16.1 and have each a bearing pad 87. The bearing pads 87 engage slidably with round bearing rods 88 fast with the cross member 68. When the rod 74 is displaced with respect to the sleeve 76 by rotation of the handle 85, the bearing pads 87 slide over the bearing rods 88 and provide lateral support and stability to the frame 16.1 and thus to the platform 12.

By operation of the handles 82 and 85 the platform 12 is adjusted angularly and linearly like the corresponding adjustments obtained by the operation of the handles 17.5 and 18.4 shown in and described with reference to FIGS. 1 and 2.

Figure 5:
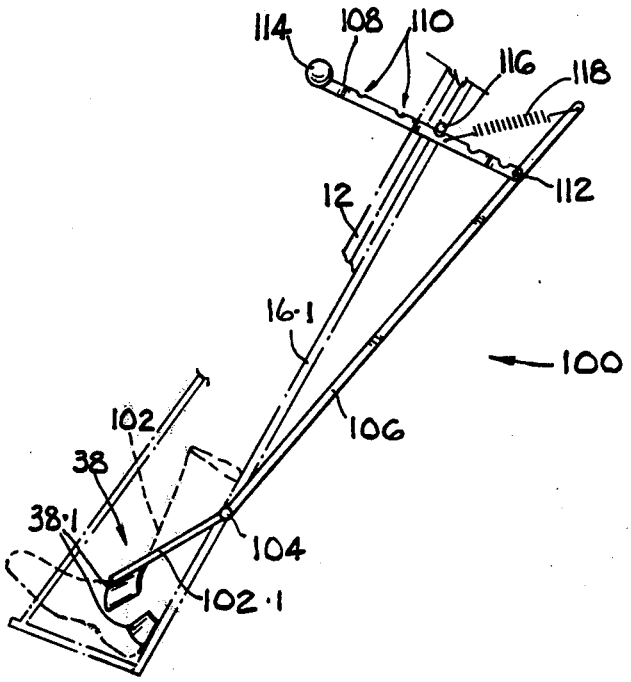
FIG. 5 is a side view of a mechanism for operating the ankle clamps in the apparatus shown in FIG. 1.

FIG. 5 shows in solid lines a mechanism 100 for operating the clamping members 38.1 shown in FIG. 1. It will be understood that there are two pairs of clamping members 38.1, one pair for each ankle 102 of a person. In each pair of clamping members 38.1 one member is fixed to the frame 16.1 on which the platform 12 is mounted (12 and 16.1 shown in chain dot lines). The other clamping member 38.1 in each pair is displaceable towards and away from the first clamping member by means of the mechanism 100. The mechanism 100 includes a lever 102.1 on which the movable member 38.1 is mounted. The lever 102.1 is fast with a shaft 104 which is rotatably mounted in the frame 16.1. A lever 106 is also fast with the shaft 104. A further lever 108 having spaced notches 110 is pivotally mounted at 112 to the lever 106. The lever 108 has an operating handle 114. The notches 110 are engageable in a stop 116 and a spring 118 between the levers 106 and 108 biases the lever 108 against the stop 116.

The mechanism 100 is operated by a person lying on the platform 12 gripping the handle 114, pushing the lever 108 away from his towards his ankles against the bias of the spring 118 to release the notch 110 from the stop 116. The lever 106 and thus the lever 102.1 are now pivoted about the shaft 104 to thereby displace the clamping members 38.1 with respect to one another so as to clamp the person's ankles 102. When the ankles are thus clamped, the mechanism is locked by engaging a suitable notch 110 on the lever 108 against the stop 116.

Referring again to FIG. 1, the rocking mechanism 40 may be suitably modified and adapted to rotate the platform 12 about the pins 15, for example by means of a crank arrangement (not shown). In this arrangement, the connecting rod 48 will be fast at 52 to the crank which will itself be fast with the platform 12 via one of the pins 15. In use the platform will thus be displaced through 360° during each revolution instead of through 180° or less when the platform is rocked by the rocking mechanism 40. Since the platform 12 will be inverted during part of each revolution, suitable securing means such as straps or clamps (not shown) may be provided in addition to the clamp 38 to secure a person to the platform 12. During each revolution a person on the platform will be displaced from one extreme position (substantially upright) to another extreme position (substantially inverted) and back again to the initial position.

I claim:

1. A therapeutic apparatus including a support, an elongate planar platform for supporting a person in a reclining position, the platform being pivotally mounted on a fulcrum on the support so as to be pivotally displaceable about a pivotal axis transverse to the longitudinal direction of the platform, the support being adapted to support the fulcrum in a sufficiently elevated position so that the platform can pivot between one extreme position in which it is in a substantially upright position and another extreme position in which it is in a substantially upright inverted position, and adjustment means for adjusting the platform with respect to the fulcrum in at least two directions transverse to one another, at least one direction being transverse to the plane of the platform, and the adjustment means for adjusting the platform in at least one direction being infinitely angularly adjustable.

2. A therapeutic apparatus according to claim 1, in which the adjustment in the direction transverse to the plane of the platform is effected by means of the adjustment means which is infinitely angularly adjustable.

3. A therapeutic apparatus according to claim 1, in which the infinitely angularly adjustable adjustment means includes a screw and nut mechanism.

4. A therapeutic apparatus according to claim 1, in which the adjustment means which is infinitely angularly adjustable includes a cradle member which is pivotally mounted on the support and to which the platform is pivotally connected.

5. A therapeutic apparatus according to claim 4, which includes a sleeve member and a rod member, the rod member being slidably received in the sleeve member, one of the members being fast with the platform and the other member being fast with the cradle member via a pivotal connection so that the platform is slidable as well as pivotable with respect to the cradle member via the sleeve and rod members.

6. A therapeutic apparatus according to claim 4, which includes a skid member interposed between the platform and the cradle member and being fast with one of these parts and being in slidable contact with the other part at the pivotal connection between these parts.

7. A therapeutic apparatus according to claim 4, in which the screw and nut mechanism is interposed between the cradle member and the platform with the screw being rotatably mounted in one of these parts and the nut being fast with the other part and with the screw being screwingly mounted in the nut so that upon rotation of the screw the nut is axially displaced on the screw to thereby effect angular displacement of the platform about its pivotal connection to the cradle member.

8. A therapeutic apparatus according to claim 4, in which the pivotal connection between the platform and the cradle member comprises a hinge connection.

9. A therapeutic apparatus according to claim 1, in which the pivotal mounting of the platform in the support is adjustable.

10. A therapeutic apparatus according to claim 1, in which the adjustment means in one direction is linearly adjustable.

11. A therapeutic apparatus according to claim 10, in which the adjustment means in the linearly adjustable direction is adjustable in the longitudinal direction of the platform.

12. A therapeutic apparatus according to claim 10, in which the adjustment means is infinitely linearly adjustable.

13. A therapeutic apparatus according to claim 12, in which the adjustment means is infinitely linearly adjustable by means of a screw and nut mechanism.

14. A therapeutic apparatus according to claim 1, which includes a clamp to clamp a person at his ankles to the platform.

15. A therapeutic apparatus according to claim 1, which includes a rocking mechanism to rock the platform about its pivotal mounting on the support.

* * * * *